US006178583B1

(12) United States Patent
Volpenhein

(10) Patent No.: US 6,178,583 B1
(45) **Date of Patent: *Jan. 30, 2001**

(54) TOOTHBRUSH HAVING BRISTLES FOR INTERPROXIMAL CLEANING

(75) Inventor: Daniel W. Volpenhein, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/322,442

(22) Filed: May 28, 1999

Related U.S. Application Data

(63) Continuation of application No. 08/644,876, filed on May 10, 1996, now Pat. No. 5,926,897, which is a continuation-in-part of application No. 08/347,624, filed on Dec. 1, 1994, now abandoned.

(51) Int. Cl.[7] ..... A46B 9/04; A46B 9/06

(52) U.S. Cl. ..... 15/167.1; 15/DIG. 5; 15/207.2

(58) Field of Search ..... 15/167.1, DIG. 5, 15/207.2, 159.1, 160, 106, 110, 186, 167.2; 132/120, 308, 309, 313, 323

(56) References Cited

U.S. PATENT DOCUMENTS

| | | | |
|---|---|---|---|
| 18,653 | 11/1857 | Wadsworth . | |
| D. 49,472 | 8/1916 | Dierke . | |
| 74,560 | 2/1868 | Maury . | |
| D. 136,042 | 7/1943 | Veo . | |
| D. 240,981 | 8/1976 | Hill et al. | D4/25 |
| D. 243,568 | 3/1977 | Axelsson | D4/25 |

(List continued on next page.)

FOREIGN PATENT DOCUMENTS

| | | | |
|---|---|---|---|
| 2433956 | 2/1976 | (DE) | 15/167.1 |
| 2757046 | 7/1979 | (DE) . | |
| 3524586 | 1/1987 | (DE) | 15/DIG. 5 |
| 3528596 | 2/1987 | (DE) | 15/167.1 |
| 454625 | 10/1991 | (EP) . | |

(List continued on next page.)

OTHER PUBLICATIONS

Eight pages of sketches illustrating various brushes and a photograph of a toothbrush marketed by Lion Corporation. Article entitled "Quality Testing the Ends of Bristles of Toothbrushes for Children" by C. Kockapan and W.E. Wetzel and "Translation of Quality Testing the Ends of Bristles of Toothbrushes for Children".

*Primary Examiner*—Gary K. Graham
(74) *Attorney, Agent, or Firm*—James C. Vago; Vanessa M. Nichols

(57) ABSTRACT

A toothbrush which provides superior cleaning as well as gum and inter dental stimulation. The toothbrush has an elongated member extending between two ends. The elongate member has a head at one of its ends. The head has a plurality of tufts comprising a multiplicity of bristles. The tufts have proximal ends attached to the head, distal ends extending outwardly from the head and sides extending between the distal and proximal ends. The distal ends of the tufts are angled downwardly from a peak so that adjacent tufts form a V shaped profile when looking at the side of the tufts. The head further includes a number of additional bristles attached thereto and extending above the peaks of the tufts. Alternatively, the tufts of bristles may include a predetermined number of bristles that are stiffer than the rest.

13 Claims, 6 Drawing Sheets

U.S. PATENT DOCUMENTS

| | | | |
|---|---|---|---|
| D. 318,760 | 8/1991 | Kreisher et al. | D4/104 |
| 759,490 | 5/1904 | Yates . | |
| 803,995 | 11/1905 | Davenport . | |
| 958,371 | 5/1910 | Daner | 15/167.1 |
| 1,018,927 | 2/1912 | Sarrazin | 15/167.1 |
| 1,059,426 | 4/1913 | Barnes | 15/167.1 |
| 1,257,883 | 2/1918 | Kone | 15/167.1 |
| 1,360,615 | 11/1920 | Bolard . | |
| 1,664,797 | 4/1928 | Stone . | |
| 1,682,548 | 8/1928 | Bigoney . | |
| 1,770,195 | 7/1930 | Burlew . | |
| 1,796,001 | 3/1931 | Church . | |
| 1,901,646 | 3/1933 | Hicks | 15/167.1 |
| 2,066,068 | 12/1936 | Cooke | 15/167.1 |
| 2,097,987 | 11/1937 | Phillips | 15/167 |
| 2,114,947 | 4/1938 | Warsaw | 15/167 |
| 2,139,593 | 12/1938 | Kohler et al. | 15/167 |
| 2,216,333 | 10/1940 | White et al. | 15/167 |
| 2,224,788 | 12/1940 | Jobst | 15/167 |
| 2,267,498 | 12/1941 | Foliot | 15/133 |
| 2,267,670 | 12/1941 | Rosenwasser | 15/143 |
| 2,304,319 | 12/1942 | Saltzman | 15/167 |
| 2,426,328 | 8/1947 | Wandel et al. | 300/21 |
| 2,445,657 | 7/1948 | Bennett | 15/167 |
| 2,567,080 | 9/1951 | Pifer | 15/167 |
| 2,631,320 | 3/1953 | Bressler | 15/167 |
| 2,702,914 | 3/1955 | Kittle et al. | 15/114 |
| 2,793,390 | 5/1957 | Adsit | 17/7 |
| 2,797,424 | 7/1957 | Olson | 15/167 |
| 3,010,131 | 11/1961 | Kisky | 15/167 |
| 3,072,944 | 1/1963 | Clayton et al. | 15/167 |
| 3,103,679 | 9/1963 | Clemens | 15/167 |
| 3,177,509 | 4/1965 | Cyzer | 15/28 |
| 3,188,673 | 6/1965 | Newman | 15/167 |
| 3,295,156 | 1/1967 | Brant | 15/167 |
| 3,742,549 | 7/1973 | Scopp et al. | 15/167 R |
| 3,949,765 | 4/1976 | Vallis | 132/11 R |
| 4,010,509 | 3/1977 | Huish | 15/167 R |
| 4,031,587 | 6/1977 | Dietrich | 15/167 R |
| 4,033,008 | 7/1977 | Warren et al. | 15/167 R |
| 4,268,933 | 5/1981 | Papas | 15/167.1 |
| 4,328,604 | 5/1982 | Adams . | |
| 4,356,585 | 11/1982 | Protell et al. | 15/111 |
| 4,403,623 | 9/1983 | Mark | 132/84 R |
| 4,432,114 | 2/1984 | Goudsmit | 15/104.93 |
| 4,493,125 | 1/1985 | Collis | 15/167 A |
| 4,502,177 | 3/1985 | Beggs | 15/167 R |
| 4,519,110 | 5/1985 | Rubin | 15/207.2 |
| 4,519,111 | 5/1985 | Cavazza | 15/167 R |
| 4,524,478 | 6/1985 | Ross | 15/106 |
| 4,570,282 | 2/1986 | Kaufman et al. | 15/167.1 |
| 4,610,045 | 9/1986 | Rauch | 15/167.1 |
| 4,637,660 | 1/1987 | Weihrauch | 300/21 |
| 4,646,381 | 3/1987 | Weihrauch | 15/167 |
| 4,672,706 | 6/1987 | Hill | 15/167 R |
| 4,679,273 | 7/1987 | Okin | 15/167 R |
| 4,712,266 | 12/1987 | Yamaki | 15/167.1 |
| 4,722,111 * | 2/1988 | Brodey et al. | 15/DIG. 5 |
| 4,724,569 | 2/1988 | Eguchi et al. | 15/167.1 |
| 4,749,233 | 6/1988 | Weihrauch | 300/21 |
| 4,766,633 | 8/1988 | Clark | 15/167.1 |
| 4,766,663 | 8/1988 | Milam | 29/455.1 |
| 4,776,054 | 10/1988 | Rauch | 15/167.1 |
| 4,804,232 | 2/1989 | Weihrauch | 300/21 |
| 4,847,936 | 7/1989 | Moglianesi et al. | 15/167.1 |
| 4,852,202 | 8/1989 | Ledwitz | 15/167.1 |
| 4,882,803 | 11/1989 | Rogers et al. | 15/167.1 |
| 4,894,880 | 1/1990 | Aznavoorian | 15/167.2 |
| 4,954,305 | 9/1990 | Weihrauch | 264/157 |
| 5,087,403 | 2/1992 | Weihrauch | 264/157 |
| 5,105,499 | 4/1992 | Dirksing | 15/167.1 |
| 5,143,425 | 9/1992 | Boucherie | 300/2 |
| 5,146,645 | 9/1992 | Dirksing | 15/167.1 |
| 5,165,761 | 11/1992 | Dirksing | 300/21 |
| 5,176,427 | 1/1993 | Weihrauch | 300/10 |
| 5,201,092 | 4/1993 | Colson | 15/167.1 |
| 5,230,118 | 7/1993 | Chamma | 15/167.2 |
| 5,249,327 * | 10/1993 | Hing | 15/DIG. 5 |
| 5,305,492 | 4/1994 | Giulani et al. | 15/176.1 |
| 5,325,560 | 7/1994 | Pavone et al. | 15/106 |
| 5,335,389 | 8/1994 | Curtis et al. | 15/167.1 |
| 5,339,482 | 8/1994 | Desimone et al. | 15/167.1 |
| 5,355,544 | 10/1994 | Dirksing | 15/105 |
| 5,459,899 | 10/1995 | Bauer | 15/167.1 |
| 5,500,975 | 3/1996 | Sano | 15/167.1 |
| 5,535,474 | 7/1996 | Salazar . | |
| 5,742,972 * | 4/1998 | Bredall et al. | 15/DIG. 5 |
| 5,926,897 * | 7/1999 | Volpenhein | 15/167.1 |

FOREIGN PATENT DOCUMENTS

| | | | |
|---|---|---|---|
| 499655 | 10/1991 | (EP) . | |
| 0471312 | 2/1992 | (EP) . | |
| 695325 | 12/1930 | (FR) . | |
| 794580 | 2/1936 | (FR) . | |
| 1012208 | 7/1952 | (FR) . | |
| 1134245 | 11/1956 | (FR) . | |
| 1467935 | 2/1967 | (FR) . | |
| 0471387 | 9/1937 | (GB) | 15/167.1 |
| 934566 | 8/1963 | (GB) . | |
| WO-A-9119437 | 12/1991 | (WO) . | |
| WO-A-9409678 | 5/1994 | (WO) . | |

* cited by examiner

TOOTHBRUSH HAVING BRISTLES FOR INTERPROXIMAL CLEANING

This is a continuation of application Ser. No. 08/644,876, filed on May 10, 1996, now U.S. Pat. No. 5,926,897, which was a continuation-in-part of application Ser. No. 08/347,624, which was originally filed on Dec. 1, 1994 now abandoned.

FIELD OF THE INVENTION

The present invention relates to toothbrushes, and more particularly, to toothbrushes having extended bristles. Moreover, the present invention also relates to toothbrushes which exhibit a three-dimensional bristle profile.

BACKGROUND OF THE INVENTION

The fundamental purpose of toothbrushes is to remove plaque and debris from tooth surfaces, both along their outer surfaces and in the inter proximal areas as well as provide gum and inter dental stimulation. There is a continuing desire to improve the inter proximal cleaning of toothbrushes, especially since many consumers do not floss. Moreover there is an additional desire to provide a toothbrush which will signal to the user that the bristles are reaching inter-proximally so that the consumer can immediately notice the improved cleaning properties of the toothbrush. While most commercially available toothbrushes clean the outer surfaces of teeth adequately toothbrushes having a three-dimensional or "V" shaped profile, when viewed from the side, render the toothbrush particularly adept at cleansing and stimulation.

However, the search for a toothbrush having superior inter proximal cleaning has not ended. There has been a desire to improve the cleaning properties of both ordinary, i.e. flat, toothbrushes and toothbrushes having a "V" shaped bristle profile.

SUMMARY OF THE INVENTION

In accordance with the present invention there is provided a toothbrush which provides superior cleaning as well as superior gum and inter dental stimulation. The toothbrush has an elongate member extending between two ends. The elongate member has a head at one of its ends. The head has a plurality of tufts comprising a multiplicity of primary bristles. The primary bristles have proximal ends attached to the head and distal ends extending outwardly from the head. The head further includes a predetermined number of extended bristles having proximal ends attached to the head and distal ends extending from the head at a distance at least 0.5 mm above all of the distal ends of the primary bristles. Alternatively, the tufts of bristles may include a predetermined number of secondary bristles which are stiffer than the primary bristles, and which may be of a different length, color, diameter, material, or cross-sectional shape than that of the primary bristles.

BRIEF DESCRIPTION OF THE DRAWINGS

While the specification concludes with claims which particularly point out and distinctly claiming the invention, it is believed the present invention will be better understood from the following description of several particularly preferred embodiments taken in conjunction with the accompanying drawings, in which like reference numerals identify similar elements and wherein;

DETAILED DESCRIPTION OF THE INVENTION

Figure 1:
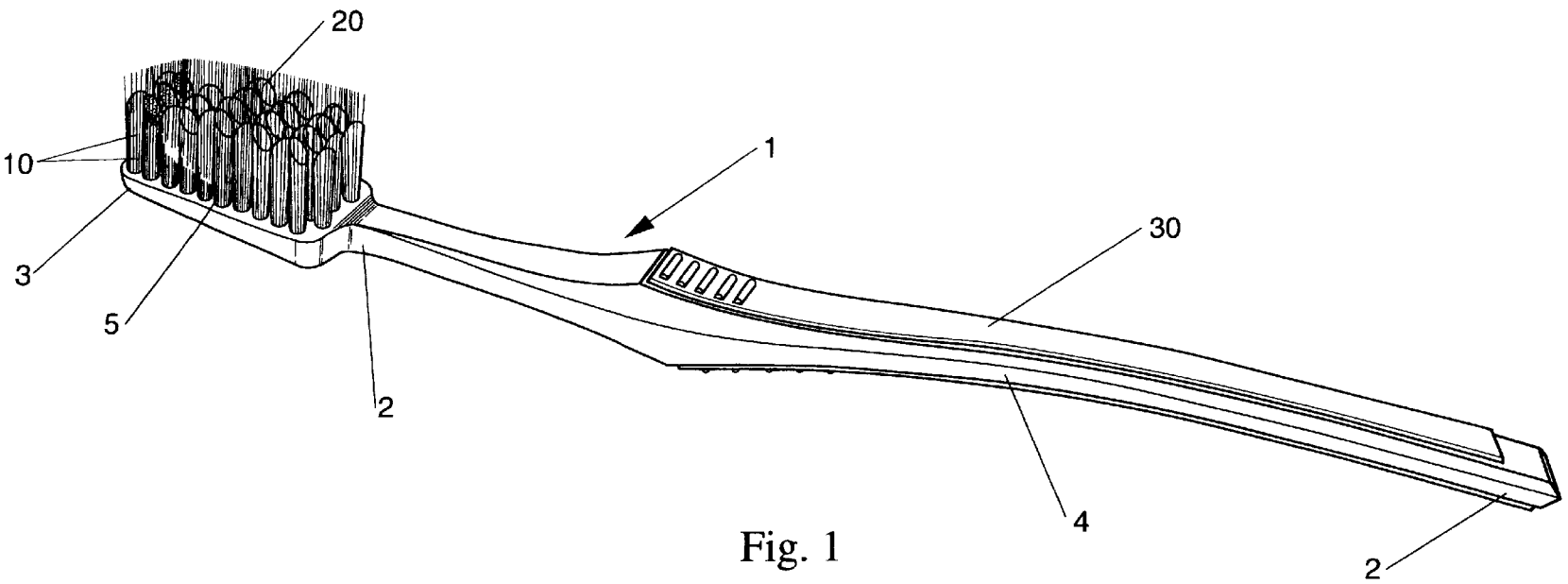
FIG. 1 is a perspective view of a preferred embodiment of the present invention.
Figure 2:
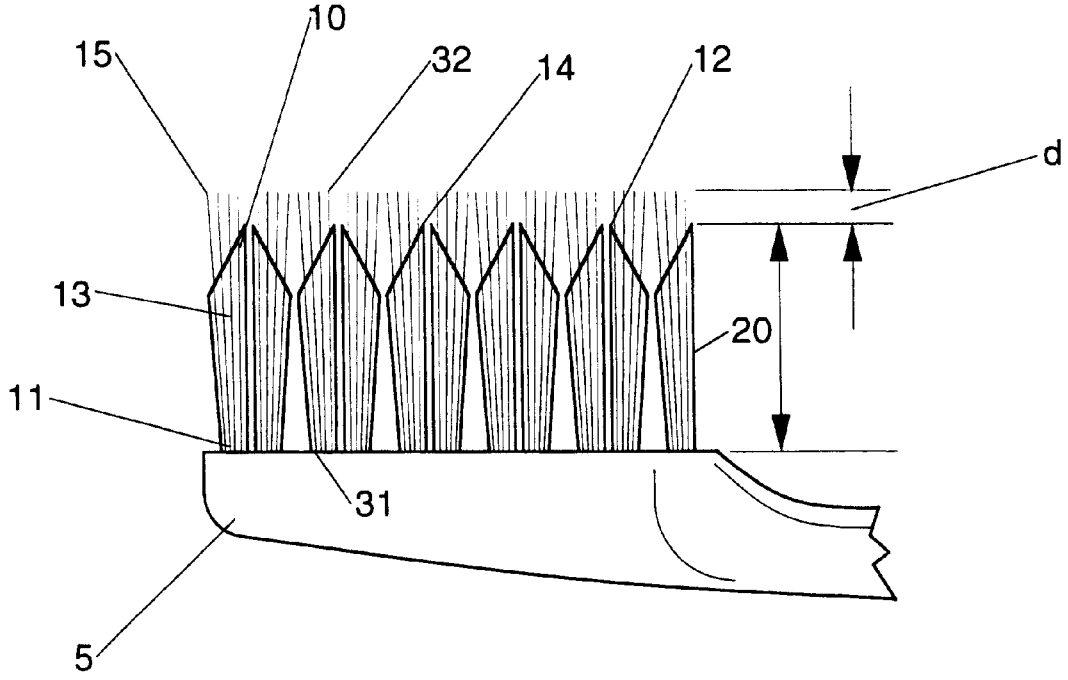
FIG. 2 is a simplified side view of the head of the brush shown in FIG. 1.
Figure 3:
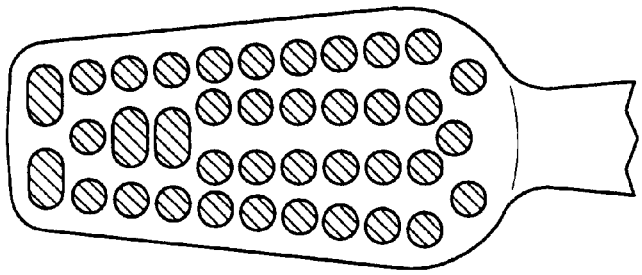
FIG. 3 is a top view of the head shown in FIG. 2.

In a particularly preferred embodiment, shown in FIG. 1, the present invention comprises a toothbrush 1, for achieving improved inter proximal cleaning and gum and inter dental stimulation. Toothbrush 1 includes an elongate member 30 extending between two ends 2 and 3. End 2 comprises a handle portion 4 and end 3 comprises a head 5. For applications such as electric toothbrushes, the handle portion 4 may comprise suitable attachment means (not shown) for securing the brush to the driving means. Head 5 has a plurality of tufts 10 comprising a multiplicity of primary bristles 20. As seen from FIG. 2 primary bristles 20 have proximal ends 11 attached to the head, distal ends 12 extending outwardly from head 5, and sides 13 extending between proximal end 11 and distal end 12. As seen from the figure, primary bristles 20 of tufts 10 may be angled downwardly from peaks 14 so that adjacent tufts form a "V" shaped profile when looking at the sides 13. Head 5 further includes a number of extended bristles 15. Extended bristles 15 have proximal ends 31 attached to the head and distal ends 32 extending outwardly from the head. Distal ends 32 of extended bristles 15 extend at least about 0.5 mm above all of the distal ends 12 of primary bristles 20. That is extended bristles 15 extend at least about 0.5 mm above the highest primary bristle of each peak 14. Extended bristles 15 can be bundled together with tufts 10. Bristles 15 provide for improved gum and inter dental stimulation. All of the bristles are preferably end rounded to protect gum tissue.

Figure 4:
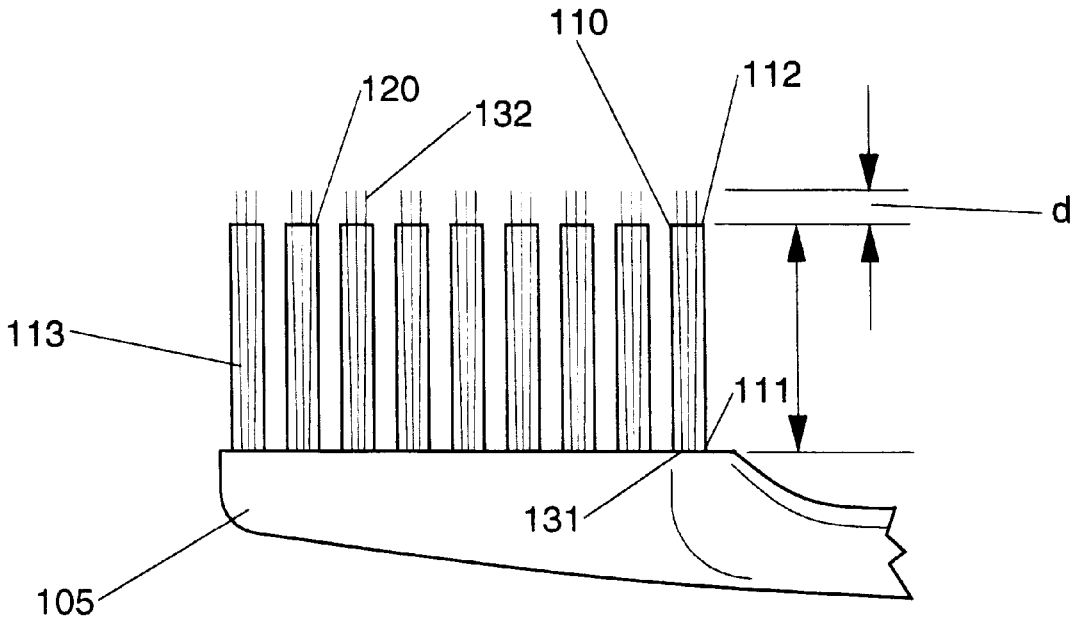
FIG. 4 is a view similar to that of FIG. 2 but showing an alternative embodiment.

The present invention, however, is not limited to toothbrushes having tufts which form a "V" shaped profile. As seen from FIG. 4, there is shown an ordinary flat toothbrush head 105. Head 105 has a plurality of tufts 110 comprising a multiplicity of primary bristles 120. Primary bristles 120 have proximal ends 111 attached to the head, distal ends 112 extending outwardly from head 105, and sides 113 extending between proximal end 111 and distal end 112. Distal ends 112 extend away from the head 105 at substantially the same distance. Head 105 further includes a number of extended bristles 115. Extended bristles 115 have proximal ends 131 attached to the head and distal ends 132 extending outwardly from the head. Distal ends 132 of extended bristles 115 extend at least about 0.5 mm above all of the distal ends 112 of primary bristles 120.

As mentioned above, head 5 further includes additional bristles 15 which provide for gum and inter dental stimulation. These additional bristles provide a soft sparse upper profile in combination with the lower V-shaped or flat profile. This dual layering provides superior mouth feel and bristle penetration. For the embodiment of FIG. 2 each tuft 10 has from about 40 to about 80 primary bristles, depending on the stiffness, and each tuft has from about 1 to about 10 extended bristles 15 which extend between about 1 mm to about 2 mm above the peak 14 of the tuft. The ratio of extended bristles to primary bristles preferably ranges from about 1:4 to about 1:40. With too many extended bristles the extended bristles will behave like an ordinary brush and will not exhibit their independent movement and penetration.

Figure 5:
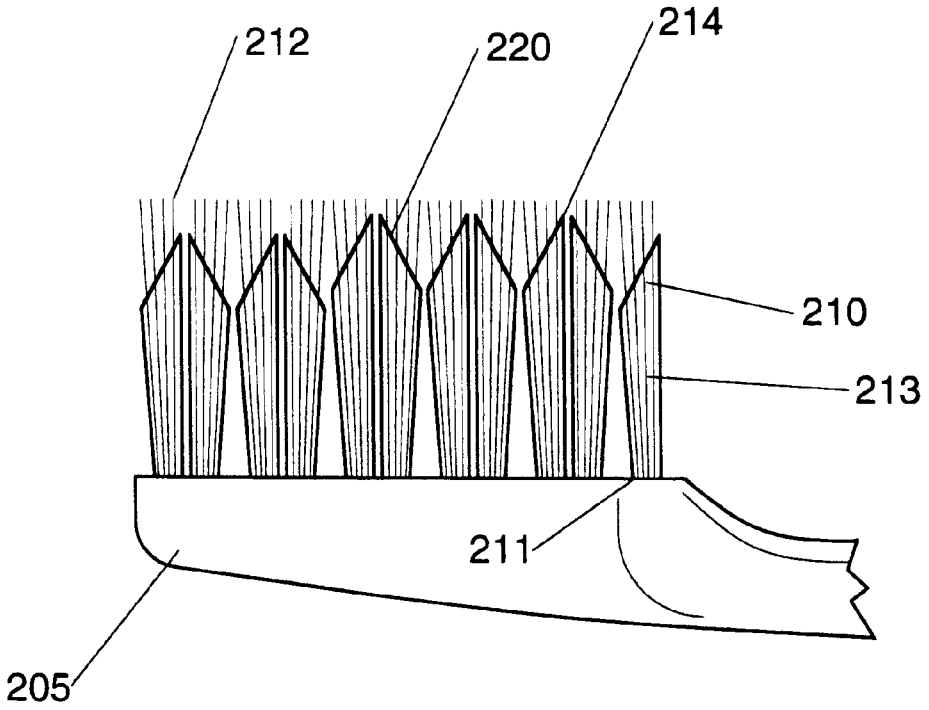
FIG. 5 is a view similar to that of FIG. 2 but showing yet another alternative embodiment.
Figure 6:
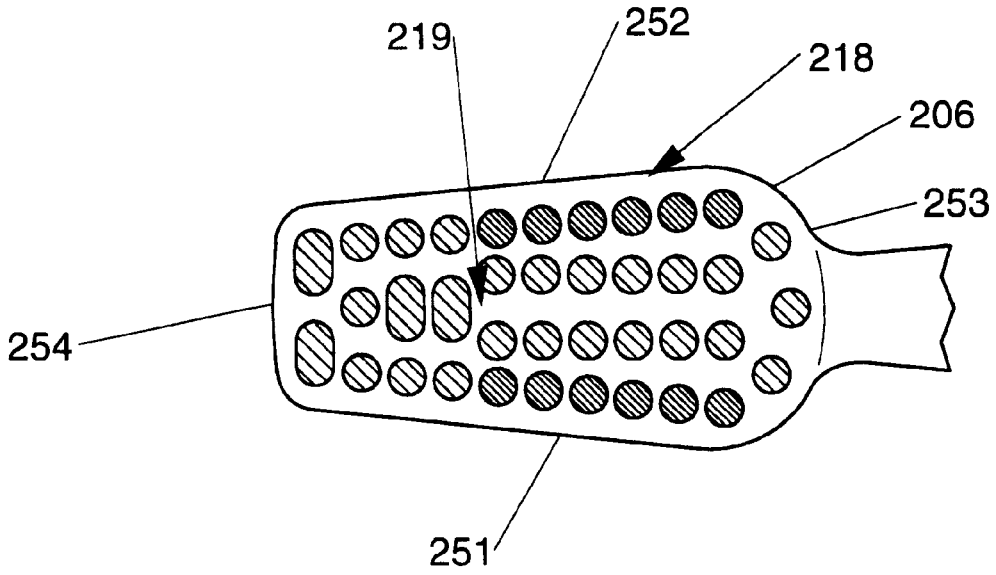
FIG. 6 is a top view of the head shown in FIG. 5.

Another alternative embodiment of a head for the toothbrush of the present invention is shown in FIGS. 5 and 6. FIGS. 5 and 6 shows head 205 which is very similar to head 5. Head 205 has a plurality of tufts 210 comprising a multiplicity of primary bristles 220. Head 205 also has a predetermined number of extended bristles 215 extending therefrom. The tufts 210 are disposed on the head so as to define outer tufts 218, adjacent the outer perimeter 206 of head 205, and inner tufts 219. As seen from the figure primary bristles 220 have proximal ends 211 attached to the head, distal ends 212 extending outwardly from head 205, and sides 213 extending between proximal end 211 and distal end 212. As seen from the figure distal ends 212 of tufts 210 are angled downwardly from peaks 214 so that adjacent tufts form a "V" shaped profile when looking at the sides 213. A predetermined number of outer tufts 218 have peaks 214 which extend outwardly from the head a greater distance than the all of the peaks of the inner tufts 219. The tufts with extended peaks are shown as being shaded in FIG. 6. This provides for improved inter proximal penetration, especially at the gum line. As seen from FIG. 6 the outer perimeter 206 of head 205 may be oblong and forms sides 251 and 252, a back 253 and a front 254. There are preferably 22 outer tufts, of which for each side the 6 tufts closest to the back 253 of the head are the ones which have peaks that extend above all of the peaks of the inner tufts. However, extended bristles 215 still extend at least about 0.5 mm above the extended peaks.

The extended outer tufts preferably have peaks that are from about 0.5 mm to about 2 mm higher than the peaks of the inner tufts and they are most preferably about 1 mm higher peak than the inner tufts. Preferably the inner tufts have a peak height of about 11.5 mm. The ratio of the peak height of the inner tufts versus the peak height of the extended outer tufts ranges from about 0.85 to about 0.96.

An alternative to the extended bristles, is to include a predetermined number of secondary bristles in each tuft along with the primary bristles. The secondary bristles would be of a higher degree of stiffness than the primary bristles. This embodiment would provide for the gum stimulation and interproximal cleaning associated with extended bristles, but without the durability issues associated with extended bristles.

A number of stiffer secondary bristles would be placed within each tuft of softer bristles; the secondary bristles could be the same length or of a different length than the primary bristles. During brushing, the soft tufts would conform to the surface of the teeth while the stiffer secondary bristles worked to stimulate the gums and penetrate between teeth. The secondary bristles could be a different color or diameter than the primary bristles. They could also be made of a different material for increased stiffness, or have a different cross-sectional shape than that of the primary bristles, such as oval, square, hexagonal, or the like.

The embodiment shown in FIGS. 1–3 and 5–6 disclose an adult full size head. However, often adults prefer a compact head where the two rows of tufts are removed leaving 18 outer tufts of which for each side the 6 tufts closest to the back 153 of the head are the ones which have peaks that extend above all of the peaks of the inner tufts.

Figure 7A:
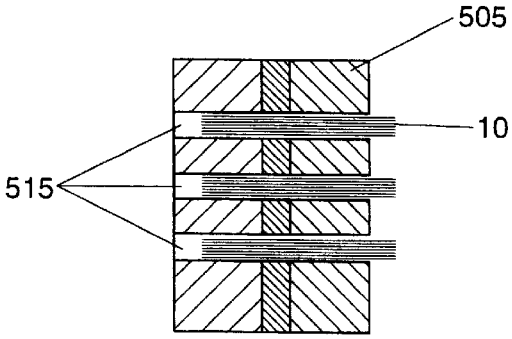
FIGS. 7A–7D are schematic figures of an apparatus for making the toothbrush of the present invention.
Figure 7B:
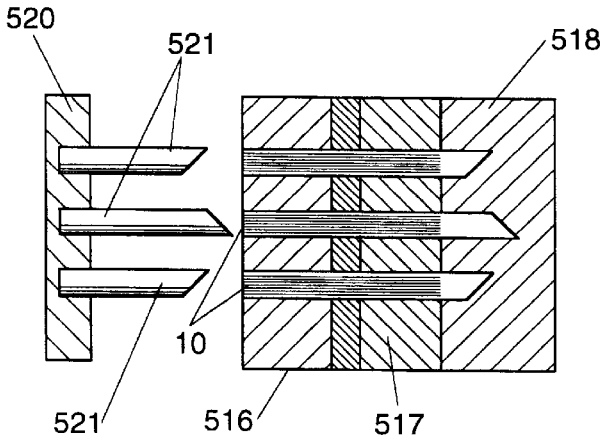
Figure 7C:
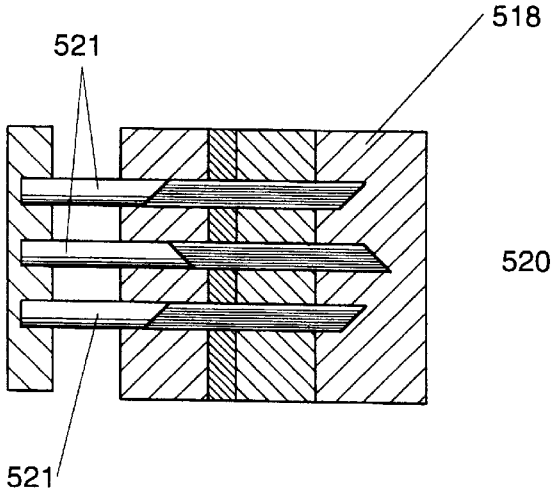
Figure 7D:
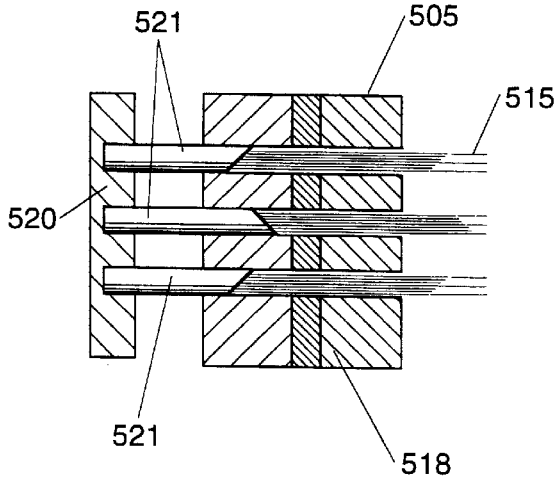

One preferred method of forming the brush is similar to the method disclosed in U.S. Pat. No. 4,979,782 issued to Weihrauch on Dec. 25, 1990, which is hereby incorporated herein by reference. How this process can be modified to make the brush of the present invention can best be described by referring to FIGS. 7A–7D, which show equipment which corresponds to FIG. 1*a*–1*i* of the above incorporated reference. FIG. 7A shows tufts 10 in clamping device 505, having canals 515, after the bristles in the tufts have been end rounded. Negative form 518 is then introduced to the rear 517 of clamping device 505 and carrier 520 having pins 521 is introduced to the front 516 of clamping device 505 as shown in FIG. 7B. Clamping device 505 then releases its grip on tufts 10. Pins 521 then move into canals 515 pushing bristles into negative form 518 and forming the profile of the tuft as shown in FIG. 7C. Another set of pins can be used instead of negative form 518. Negative form 518 is removed and extended bristles 15 are inserted into the tufts as shown in FIG. 7D. Clamping device 505 can then grip the tufts 10 and the extended bristles 15 can be trimmed and end rounded. Thereafter the tufts can be attached to head 5 by any known method including the one described in U.S. Pat. No. 4,637,660 issued to Weihrauch on Jan. 20, 1987, which is hereby incorporated herein by reference.

Although particular embodiments of the present invention having been shown and described, modification may be made to the toothbrush without departing from the teachings of the present invention. Accordingly, the present invention comprises all embodiments within the scope of the appended claims.

What is claimed is:

1. A toothbrush comprising:

(a) an elongate member extending between two ends, said elongate member having a head at one of said ends; and (b) said head having a plurality of tufts, each tuft comprising a multiplicity of primary bristles and a predetermined number of secondary bristles, said primary bristles and said secondary bristles having proximal ends attached to said head and distal ends extending outwardly from said head, said tufts having proximal ends attached to said head, distal ends extending outwardly from said head and sides extending between said distal and proximal ends, each tuft having a peak, pairs of adjacent tufts having peaks positioned adjacent one another, said distal ends of said primary bristles in each tuft being angled downwardly from said peak so that the distal ends of primary bristles of adjacent pairs of tufts form a V-shaped profile when looking at said side of said tufts, said secondary bristles extending out from said head to free ends a distance at least 0.5 mm above the highest primary bristle of each peak to form a sparse upper profile in combination with the lower V-shaped profile of said primary bristles; and (c) wherein said head has an outer perimeter and wherein said tufts are arranged on said head so as to define outer tufts adjacent said outer perimeter of said head and inner tufts, wherein a predetermined number of said outer tufts have their peaks extending further away from said head than all of said peaks of said inner tufts.

2. The toothbrush according to claim 1 wherein each tuft has from about 40 to about 80 primary bristles and from about 1 to about 10 secondary bristles.

3. The toothbrush according to claim 1 wherein the ratio of secondary bristles to primary bristles ranges from about 1:4 to about 1:40.

4. The toothbrush according to claim 1 wherein the secondary bristles are a different color than the primary bristles.

5. The toothbrush according to claim 1 wherein the secondary bristles have a different diameter than the primary bristles.

6. The toothbrush according to claim 1 wherein the secondary bristles are made of a different material than the primary bristles.

7. The toothbrush according to claim 1 wherein the secondary bristles have a different cross-sectional configuration than the primary bristles.

8. A toothbrush comprising:

(a) an elongate member extending between two ends, said elongate member having a head at one of said ends; and (b) said head having a plurality of tufts, each tuft comprising a multiplicity of primary bristles and a predetermined number of secondary bristles, said primary bristles and said secondary bristles having proximal ends attached to said head and distal ends extending outwardly from said head, said tufts having proximal ends attached to said head, distal ends extending outwardly from said head and sides extending between said distal and proximal ends, each tuft having a peak, pairs of adjacent tufts having peaks positioned adjacent one another, said distal ends of said ends attached to said head and distal ends extending outwardly from said head, said tufts having proximal ends attached to said head, distal ends extending outwardly from said head and sides extending between said distal and proximal ends, each tuft having a peak, pairs of adjacent tufts having peaks positioned adjacent one another, said distal ends of said primary bristles in each tuft being angled downwardly from said peak so that the distal ends of primary bristles of adjacent pairs of tufts form a V-shaped profile when looking at said side of said tufts, said secondary bristles extending out from said head to free ends above the highest primary bristles of each peak to form a sparse upper profile in combination with the lower V-shaped profile of said primary bristles; and (c) wherein said head has an outer perimeter and wherein said tufts are arranged on said head so as to define outer tufts adjacent said outer perimeter of said head and inner tufts, wherein a predetermined number of said outer tufts have their peaks extending further away from said head than all of said peaks of said inner tufts.

9. The toothbrush according to claim 8 wherein said predetermined number of outer tufts which have their peaks extending further away from said head than said peaks of said inner tufts are those most adjacent said elongate member.

10. The toothbrush according to claim 8 wherein said head is oblong and defines a back, adjacent to said elongated member, a front and two sides.

11. The toothbrush according to claim 10 wherein there are 22 outer tufts of which the 6 tufts on each side closest to said back of said head have their peaks extending further away from said head than said peaks of said inner tufts.

12. The toothbrush according to claim 10 wherein there are 18 outer tufts of which the 6 tufts on each side closest to said back of said head have their peaks extending further away from said head than said peaks of said inner tufts.

13. The toothbrush according to claim 8 wherein said predetermined number of outer tufts which have their peaks extending further away from said head than said peaks of said inner tufts extend from about 0.5 mm to about 2 mm above the peaks of said inner tufts.

* * * * *